United States Patent [19]

Gardner

[11] Patent Number: 4,491,558

[45] Date of Patent: Jan. 1, 1985

[54] AUSTENITIC MANGANESE STEEL-CONTAINING COMPOSITE ARTICLE

[75] Inventor: Richard N. Gardner, Stillwater, Minn.

[73] Assignee: Minnesota Mining and Manufacturing Company, St. Paul, Minn.

[21] Appl. No.: 318,430

[22] Filed: Nov. 5, 1981

[51] Int. Cl.[3] ..... B22F 3/26; B22F 7/00

[52] U.S. Cl. ..... 419/23; 428/567; 428/548; 419/27

[58] Field of Search ..... 75/203, 236; 428/546, 428/567, 568; 419/14, 15, 17, 18, 27

[56] References Cited

U.S. PATENT DOCUMENTS

| | | | |
|---|---|---|---|
| 2,456,779 | 12/1948 | Goetzel | 416/248 |
| 3,459,547 | 8/1969 | Andreotti et al. | 75/208 |
| 3,652,261 | 3/1972 | Taubenblat | 428/567 |
| 3,708,281 | 1/1973 | Andreotti et al. | 75/124 |
| 4,071,354 | 1/1978 | Mocaraki | 75/0.5 R |
| 4,092,223 | 5/1978 | Kaufman | 204/23 |
| 4,123,265 | 10/1978 | Takahashi | 428/567 |
| 4,327,156 | 4/1982 | Dillon | 428/567 |

OTHER PUBLICATIONS

Avery, "Austenitic Manganese Steel", ASM Metals Handbook, 8th Edition, vol. 1, p. 6 (1977).

Kornmann et al., "Manganese Diffusion Coating of Steels," *Metals Technology*, p. 218, (Apr. 1977).

Salak, "Sintered Manganese Steels, Parts I and II," Powder Metallurgy International, 12, 1 and 2 (1980).

"Wetting of Ceramic Oxides by Molten Metals Under Ultra High Vacuum", F. L. Harding and D. R. Rossington, J. Am. Cer. Soc. 53, 2, 87–90 (1970).

"The Wetting of TaC by Liquid Cu and Liquid Ag", S. K. Rhee, J. Am. Cer. Soc. 55, 3, 157–159 (1972).

*Primary Examiner*—Benjamin R. Padgett
*Assistant Examiner*—Anne Brookes
*Attorney, Agent, or Firm*—Donald M. Sell; James A. Smith; David R. Cleveland

[57] ABSTRACT

A precision molded article, such as a die cavity, is made by combining iron powder granules and optional manganese granules with a heat fugutive organic binder, molding the granule-binder mixture into a green molded preform, thermally degrading and removing essentially all the binder to form a skeletal preform, and infiltrating the preform with an infiltrant which has a lower melting point than the iron powder granules and which optionally contains manganese, with the proviso that either the above decribed manganese granules are employed or manganese-containing infiltrant is employed, thereby forming a molded article having a skeleton of ferroalloy granules having a martensitic or perlitic core and an outer layer of austenitic manganese steel, the skeleton being surrounded by infiltrant.

25 Claims, 5 Drawing Figures

AUSTENITIC MANGANESE STEEL-CONTAINING COMPOSITE ARTICLE

TECHNICAL FIELD

This invention relates to powder metallurgy, metal composite materials, precision molded articles made from such materials, and a process for forming said articles.

BACKGROUND ART

Iron or steel articles having a surface layer of austenitic manganese steel ("Hadfield" manganese steel) are well known in the metallurgical art, see, e.g., Avery, "Austenitic Manganese Steel," *ASM Metals Handbook*, 8th Edition, Vol. 1, p. 6 (1977), and Kornmann et al., "Manganese Diffusion Coating of Steels," *Metals Technology*, p. 218, (April, 1977). Hadfield manganese steel is characterized by an ability to undergo work hardening and by a substantial resistance to impact and abrasion. However, a drawback to the use of Hadfield manganese steel is its susceptibility to plastic deformation under load.

Powder metallurgy techniques have been used to make iron and steel articles containing manganese as an alloying ingredient, see, e.g., U.S. Pat. Nos. 3,459,547, 3,708,281, 4,071,354, 4,092,223, Salak, "Sintered Manganese Steels, Parts I and II," Powder Metallurgy International, 12, 1 and 2 (1980), and Schwarzkopf, *Iron Steel Inst. Special Report No.* 58, pp. 55–58 (1956). The manganese-containing articles described in these references are compacts made by pressing methods, and such articles therefore do not have uniform density and homogeneous composition. Also, the articles of these references generally have a low manganese content (for example, less than one percent by weight of the final article in many cases) or have a fully homogeneous manganese composition, or have both low manganese content and homogeneous manganese composition. In addition, one of these references (viz., U.S. Pat. No. 4,071,354) reported that manganese diffusion into iron occurred very rapidly, and much more rapidly than diffusion of metals such as molybdenum, nickel, and chromium into iron.

A need exists for a process and articles which provide precision molded articles (such as die cavities) with abrasion resistance and impact resistance comparable to Hadfield manganese steel, but with greater resistance to plastic deformation than that exhibited by Hadfield manganese steel.

DISCLOSURE OF INVENTION

In the present invention, diffusion of manganese into iron can be controlled in such a way as to provide microregions of enhanced manganese content in the articles of the invention. These microregions of enhanced manganese content are in the form of a layer of austenitic manganese steel encapsulating core regions of martensitic or perlitic steel. The microregions of enhanced manganese content and their position in the articles of the invention provide a fundamental change in the dynamics of crack propagation throughout such articles.

Cracks in the articles of the invention can arise due to dynamic load, and, in some articles of the invention, may be present as inherent defects. Crack formation and propagation in the articles of the invention is arrested or minimized. The presence of microregions of enhanced manganese content in the articles of the invention yields increased fracture toughness, while maintaining or enhancing control over dimensional change encountered during manufacture of such articles, when compared to otherwise identical articles (not of this invention) prepared without microregions of enhanced manganese content.

The present invention provides, in one aspect, a metal composite article, comprising:

(a) a monolithic skeleton comprising interconnected granules of ferroalloy of about 1 to about 100 micrometers mean diameter, said granules having a core of martensitic or perlitic steel and an outer layer of austenitic manganese steel; and (b) a continuous metallic phase occupying the connected porosity in said skeleton, said continuous phase comprising a solid metal or alloy which wets said skeleton and has a melting point below the melting point of said core of said ferroalloy granules;

with said manganese of said layer of austenitic manganese steel representing between about 4 percent and about 70 percent of the total weight of said continuous metallic phase plus said manganese of said layer, said article thereby comprising two intermeshed matrices and being substantially free of voids.

The present invention also provides two processes for making such articles.

BRIEF DESCRIPTION OF DRAWING

In the accompanying drawing.

DETAILED DESCRIPTION

Figure 1:
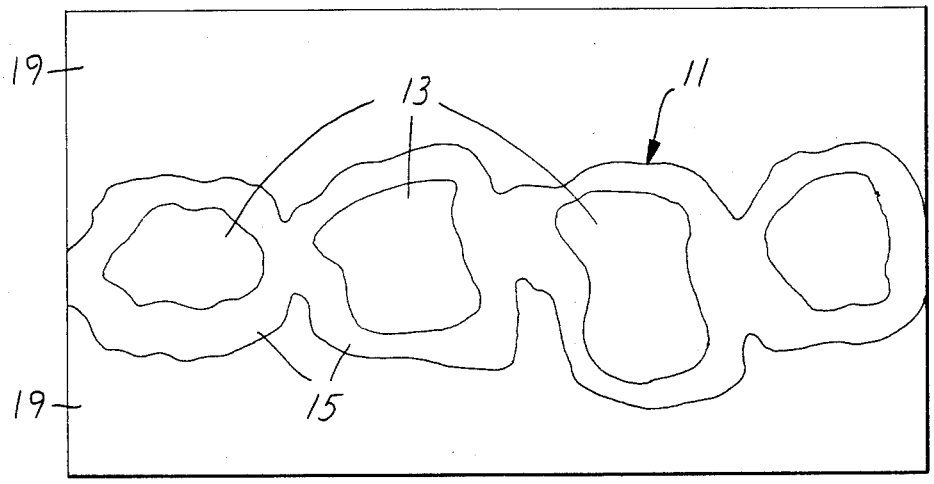
FIG. 1 is a schematic diagram (e.g., at 150×) of a microportion of one embodiment of an article of this invention.

In the practice of this invention, a replicating master of the desired shape and size is used to prepare a flexible rubber mold. Next, one of two processes is followed. In a preferred process for making the articles of the invention ("Process A") granules of iron or ferroalloy, most preferably ferroalloy, (hereafter referred to collectively as the "iron powder") are mixed with a heat fugitive binder and the powder-binder mixture is then placed in said mold and thereby molded into a shape that is the same as the desired final shape. The powder-binder mixture is cured in the flexible mold and the resulting cured, molded "green" article is demolded and heated to thermally degrade and remove essentially all of the binder. The resulting porous molded shape or "preform" is then infiltrated at a temperature below the melting point of said iron powder with an infiltrant containing manganese and said metal or alloy of said continuous metallic phase.

In an alternative process for making the articles of the invention ("Process B"), said iron powder is combined with granules comprising manganese (hereafter, "manganese granules"). The resulting powder mixture is mixed with said heat fugitive binder and shaped as above to form a green article, which green article is heated as above to form a porous preform. The preform is then infiltrated at a temperature below the melting point of said iron powder with an infiltrant containing said metal or alloy of said continuous metallic phase.

After carrying out either of the two above-described processes, the infiltrated article is optionally heat treated to improve its physical properties. During the infiltration step, manganese (from the infiltrant or from the manganese granules) partially diffuses into the iron powder granules, transforming the outer surface portions of said iron powder granules to austenitic manganese steel. Other diffusible species (e.g., tin or nickel) which may optionally be present in the infiltrant or in the manganese granules also diffuse into the iron powder granules. When plain iron granules are used as the iron powder, then carbon must be present in the infiltrant or in the manganese granules, and will diffuse into the iron powder granules to convert the cores thereof to a region of martensitic or perlitic steel.

During infiltration, time and temperature of heating is controlled so as to avoid diffusion of manganese throughout said iron powder granules, and to preserve in the core of such granules said region of martensitic or perlitic steel. After cooling the final article, the infiltrated skeleton corresponds in shape to that of the replicating master. In this skeleton, the connected porosity (i.e., void space which is not sealed off or isolated from porosity which communicates with the exterior of the skeleton, in contrast to "closed porosity" which is inacessible void space wholly within the body of the skeleton) is occupied by the infiltrant. The infiltrated, molded article contains dispersed (i.e., interconnected) granules of ferroalloy, each of which has a core of martensitic or perlitic steel surrounded by a layer of austenitic manganese steel. The ferroalloy granules are bound together at their points of contact to form said skeleton, which skeleton is in turn intermeshed with infiltrant having lower melting point (and therefore lower hardness and higher impact strength) than said cores of said iron powder granules. The article as a whole exhibits high hardness, high impact strength, work-hardening capability, and high resistance to plastic deformation, and is a faithful replica of the master used to prepare the mold from which the molded preform was made.

The microstructure of a molded article of the present invention can be further understood by reference to FIG. 1. Referring to FIG. 1, shown in schematic view are granules of iron powder 11. The iron powder granules have a martensitic or perlitic steel core 13 and a surface layer 15 of austenitic manganese steel. Surface layer 15 is in turn intermeshed with or surrounded by infiltrant 19. The core 13 of the iron powder granules 11 is not in contact with infiltrant 19.

When a representative metallurgically-prepared cross-section of an article of this invention is examined with a light microscope at a magnification at which said two matrices are discernible, e.g., 150×, the ferroalloy granules are essentially uniformly distributed throughout the skeleton and the article. Of course, at much higher magnifications, the ferroalloy granules may no longer appear to be uniformly distributed within the field of view. There is no unique axis or densification of the ferroalloy granules in any portion of the skeleton (especially in the peripheral portion, i.e., the portion adjacent the surface of the article), such as that otherwise indicative of the use of pressure to shape the final article. The molded articles of the present invention are essentially free of interior and surface defects, such as voids or pits, and exhibit physical, chemical, electrical, and mechanical properties which are uniform from article to article.

The uniform properties from article to article and precision tolerance of the articles of this invention means that these articles are particularly well-suited for applications where high hardness, wear and impact resistance, and close dimensional tolerances are desirable, such as articles with intricate or complex shapes and surfaces with fine details, e.g., stamping and injection molding die cavities which are used to make metal or plastic parts whose shape corresponds to the shape of the die.

The replicating master used to prepare molded articles according to the present invention can be made in a conventional manner from wood, plastic, metal, or other machinable or formable material. If a molded article prepared according to the process of the present invention exhibits dimensional change (e.g., shrinkage), then the dimensions of the replicating master can, in some cases, be adjusted (e.g., made larger) to compensate for those dimensional changes occurring during processing. Such adjustment may be desirable in the manufacture of large articles of this invention, such as articles with a volume of 1 liter or more.

The metal articles produced in the practice of this invention can have a working surface (that is, a working portion) that comes into contact with and effectuates a deformation in a material to be worked, and a support portion that maintains the working surface in the proper position to produce the desired deformation. For example, a core pin, produced according to this invention, can be used to form a hole in an injection molded plastic part. The working surface of such a core pin is that portion that actually comes into contact with the plastic material to be molded and the support portion holds the core pin in position so that the desired hole is produced.

The preferred master has the working surface and support portion mounted on and extending out of or away from a base. The base may be the remainder of the material from which the working surface-support portion was produced, or the working surface-support portion may be mounted on a separate base after production. If the preferred master is used, then in the later light sintering step a one-piece porous metal skeleton will be produced having a working surface-support portion mounted on a base. After infiltration, the base may be completely removed or machined to a desired configuration to be used as the support portion for the working surface. In this latter instance, the base functions as both the support portion and base and therefore the working surface may be mounted directly on the base.

The molding materials which can be used to prepare a flexible mold in the process of this invention are those which cure to an elastic or flexible rubbery form and generally have a Shore A durometer value of about 25–60, and reproduce the fine details of the replicating master without significant dimensional change, e.g., without more than 0.5 percent linear change from the replicating master, and preferably with essentially zero linear change. The molding materials should not be degraded when heated to molding temperatures, e.g., 180° C., and desirably should have a low cure temperature, e.g., room temperature. A low temperature curing molding material will form a mold which maintains close dimensional control from master to mold, while a high temperature curing molding material will generally produce a mold having dimensions which differ undesirably from those of the master. To maintain dimensional control, it is preferable that the mold material have a low sensitivity to moisture. Examples of suitable molding materials are curable silicone rubbers, such as those described in Bulletin "RTV" 08-347 of January, 1969, of the Dow Corning Co., and low exotherm urethane resins. Such molding materials cure to an elastic or rubbery form having a low post cure shrinkage. The molding material can be optionally reinforced by the addition of about 30 volume percent of less than 44 micrometer diameter glass beads which may improve dimensional control in the molding process, particularly in the molding of parts having a volume greater than about 450 $cm^3$.

The amount of molding material used to form a mold of the replicating master can vary depending on the particular molding material used and the shape of the replicating master. It has been found that about 10 to 14 $cm^3$ of molding material for each cubic centimeter of the replicating master will form a mold which retains the desired flexible properties and also has sufficient strength to resist the small hydrostatic head produced by the warm powder-binder mixture in the mold before solidification of the binder.

The molding conditions for molding the articles of this invention permit the use of an inexpensive, soft, elastic or rubbery mold because the only pressure applied is the hydrostatic head of the warm metal powder-binder mixture in the mold, which pressure is much less than that used in conventional powder metallurgy compaction. The mild molding conditions thus help ensure a precisely molded green article even though a deformable mold is used. In addition, the molding technique results in a molded green article with a uniform density.

The ferroalloy granules are preferably present in the final molded, infiltrated article in amounts between about 50 and 80 volume percent, and more preferably between about 65 and 75 volume percent. The iron powder granules used to make the final molded article can be regularly or irregularly shaped particles having an original mean diameter which is between about 1 and 100 micrometers, and preferably between about 1 and 44 micrometers (as determined by Coulter Counter).

Suitable iron powders which are useful in this invention include plain iron, and low, medium, and high carbon steels (having sufficiently low manganese content so that they are not already Hadfield manganese steels) such as AISI types $A_6$, 1040, 1018, and $M_2$ tool steels. When plain iron granules are used as the iron powder, then the infiltrant (or manganese granules, when used) should contain sufficient carbon to allow for diffusion of carbon into the plain iron granules, thereby converting such iron granules to steel granules. $A_6$ tool steel is a preferred iron powder.

If the above-described Process B is used to make articles of the invention, the manganese granules can be plain manganese or manganese alloy (e.g., copper-manganese alloy) and preferably are essentially oxide-free. The manganese granules can be regularly or irregularly shaped particles having an original mean diameter of about 1 to about 20 micrometers, preferably about 1 to about 10 micrometers.

Organic binders suitable for use in this invention are those which melt or soften at low temperatures, e.g., less than 180° C., preferably less than 120° C., thereby providing the metal powder-binder mixture with good flow properties when warmed and yet allowing the metal powder-binder mixture to be solid at room temperature so that a green article molded therefrom can be normally easily handled without collapse or deformation. The binders used in this invention are those which are heat fugitive, that is, which burn off or volatilize when the green molded preform is heated. Preferred heat fugitive binders degrade without causing internal pressures on the resulting skeletal preform (which promote internal fractures) and without leaving substantial binder residue in the skeletal preform. Preferably, during heating of the molded metal powder-binder mixture, the chosen binder gradually degrades or decomposes at a low temperature and leaves a minimal carbonaceous residue.

Organic thermoplastics or mixtures of organic thermoplastics and organic thermosets are used as binders. Thermoplastic materials generally leave lower carbonaceous residues than thermoset materials when thermally degraded. Thermoplastic-thermoset binder mixtures tend to produce green articles that have higher green strength and thus are more handleable than green articles made with just a thermoplastic as the binder. Also, thermoplastic-thermoset binder mixtures can be processed without obtaining solidification shrinkage, while the use of a thermoplastic binder such as "Emerest" 2642 alone generally leads to minor lineal solidification shrinkage. Thermoplastic-thermoset binder mixtures are preferably cured by heating the warmed, vibrated mixture of powders in the mold.

The use of a mixture of thermoplastic and thermoset binder is particularly advantageous when large composite articles are prepared, such as articles in which some of the binder degradation products must escape from the internal portion of the article through a distance greater than about 2 cm. Preferably the thermoplastic binder in such thermoplastic-thermoset binder mixtures is a low molecular weight thermoplastic material or mixture of such materials, thereby enabling stepwise degradation of the binder components and orderly removal of the binder from the green molded article during heating thereof, without causing internal fractures in the molded article. Such a step-wise burn-off is carried out by heating the green molded article to two or more successive temperatures, those temperatures being the individual decomposition temperatures of the thermoplastic and thermoset portions of the binders. Alternatively, the thermoplastic portion of the binder may be substantially removed by solvent leaching followed by thermal degradation of the thermoset portion of the binder.

A further alternative binder system employs one or more diluents with the binder. The diluents volatilize prior to any significant binder degradation and thus provide open passages for the thermal degradation products during burn-off, reducing or eliminating internal fractures in the molded article. The diluent(s) should be liquid(s) which are good solvents for the uncured binder but poor solvents for the cured binder. The diluent(s) should be minimally absorbed by the flexible molding material. Also, the diluent(s) should have sufficiently high boiling points so that they do not boil away before curing or setting of the binder, and sufficiently low boiling points so that they volatilize before the binder begins to thermally degrade.

As the ratio of binder resin to the total amount of thermoplastic binder plus diluent decreases, binder flow increases, metal powder loading increases, deairing of the binder-metal powder mixture becomes easier, and there is less tendency for the molded part to crack or blister during binder degradation. However, as such ratio decreases, green part rigidity and green-state dimensional stability generally decreases.

Representative thermoplastic binders which can be used include paraffin, e.g., "Gulf Wax" (household grade refined paraffin), a combination of paraffin with a low molecular weight polyethylene, mixtures containing oleic or stearic acids or lower alkyl esters thereof, e.g., "Emerest" 2642 (polyethylene glycol distearate, average molecular weight of 400) or Carbowax 200 (polyoxyethylene glycol, average molecular weight of 200), as well as other waxy and paraffinic substances having the softening and flow characteristics of paraffin. "Emerest" 2642 is a preferred thermoplastic binder because it is absorbed by a flexible silicone rubber mold to a lesser degree than many other thermoplastics. "Carbowax" 200 is a preferred thermoplastic binder for use in thermoplastic-thermoset binder mixtures.

Representative thermosetting binders which can be used in combination with thermoplastics include epoxide resins, e.g., diglycidyl ethers of bisphenol A such as 2,2-bis[p-(2,3-epoxypropoxy)phenyl] propane, which can be used with appropriate curing catalysts. Care must be exercised so as not to thermally induce cross-linking during the mixing and molding steps when thermosetting binders are used.

Representative solvents which can be used for leaching out the thermoplastic portion of a thermoplastic and thermoset binder mixture are ketones such as acetone or methyl ethyl ketone, and aqueous solvents.

Representative diluents which can be used are those which volatilize at temperatures of about 150° C. to 210° C., such as low molecular weight polyoxyglycols and light hydrocarbon oils. A preferred diluent is 1,3-butanediol (b.p. 204° C.).

A particularly useful thermoplastic-thermoset binder mixture can be made from 29.6 parts "Epon" 825 bisphenol-A epoxy resin, 9.1 parts "Epi-cure" 872 polyamine curing agent, 29.25 parts of "Carbowax" 200 polyethylene glycol, and 35.75 parts 1,3-butanediol. This binder should be heated to about 40° C. in order to provide adequate flow of the binder-metal powder mixture during filling of the mold. The amounts of components given above may have to be empirically adjusted to optimize production of a given part shape or size.

The infiltrant (i.e., the continuous metallic phase, referred to as component (b) above) in the final shaped article has a melting temperature below the melting temperature of the core of the ferroalloy granules of the skeleton. Also, the infiltrant is a solid in the final article at room temperature. The infiltrant must also "wet" the skeleton. Such wetting can occur either because the infiltrant wets the iron powder granules or because an alloying ingredient within the infiltrant reacts to form an alloy with the iron powder granules, which alloy coats the iron powder granules and is wet by the infiltrant. Wetting of the skeleton by the infiltrant can be determined empirically (by testing to see if infiltration occurs) or by determining if the infiltrant will wet the iron powder granules according to the sessile drop test. Wettable combinations of infiltrant and iron powder granules will have a sessile drop test wetting angle of 90° or less under a hydrogen atmosphere. The sessile drop test is described, for example, in "Wetting of Ceramic Oxides by Molten Metals under Ultra High Vacuum", F. L. Harding and D. R. Rossington, J. Am. Cer. Soc. 53, 2, 87–90 (1970) and in "The Wetting of TaC by Liquid Cu and Liquid Ag", S. K. Rhee, J. Am. Cer. Soc. 55, 3, 157–159 (1972). The empirical test is the most reliable indication that the infiltrant will wet the skeleton, because the wetting of the skeleton which occurs may be due to the above-described formation of intermediate alloys of iron powder granules with an alloying ingredient present in the infiltrant. Formation of such wettable alloys may be difficult to predict in advance. However, the sessile drop test is generally reliable and serves as a useful guide in predicting whether or not the infiltrant will wet the skeleton.

The infiltrant preferably occupies about 20 to about 50 volume percent, and most preferably 25 to about 35 volume percent of the final molded, infiltrated article. The infiltrant can be used in any convenient form (e.g., granules, sheets, foil, or beads) as it is melted during infiltration of the skeleton. Suitable infiltrants include copper, copper alloys (e.g., copper-manganese alloys), silver, silver alloys, tin, tin alloys, iron, and multicomponent alloys such as ferroalloys. Copper-manganese alloys are preferred infiltrants, especially when the above-described Process A is used to prepare articles of the invention. Such copper-manganese alloys preferably contain about 15 to about 45 weight percent manganese, and most preferably about 20 to 30 weight percent manganese. Other alloying ingredients can be added to the infiltrant to enhance the properties of the final molded article. For example, in an article of this invention containing copper alloy infiltrant, the presence of boron, magnesium, indium, or silver as alloying ingredients in the infiltrant will enhance the fluidity of the molten infiltrant. The presence of nickel and tin as alloying ingredients in the infiltrant will enhance the toughness of the final article through promotion of spinodal decomposition as the infiltrant cools. The presence of iron as an alloying ingredient in the infiltrant will decrease the corrosive action of the infiltrant upon the skeleton and thereby improve the dimensional stability of the final article. Silicon, when present as an alloying ingredient in the infiltrant will act as a deoxidizer for other alloying ingredients of the infiltrant.

The articles of this invention can contain other materials (e.g., dissolved gases) if such materials are desired in order to alter the physical properties of the final article. However, the presence of such materials is not required in this invention, and the articles of the invention can consist essentially of or consist of granules of ferroalloy and infiltrant.

When a skeletal preform containing the above-described iron powder granules (and optional manganese granules where Process B is used) is placed adjacent the above-described infiltrant and heated above the melting point of the infiltrant, the infiltrant will melt and "wick" into the interior of the preform. Additional heating results in diffusion of manganese into the outer surface region of the iron powder granules and formation of an outer layer of austenitic manganese steel at the periphery of said iron powder granules. The inner or core portions of said iron powder granules have, at infiltration temperatures, an austenitic steel structure containing less manganese than the outer layer. The iron powder granules (now in the form of ferroalloy granules having austenitic cores and outer layers of austenitic manganese steel) are in the form of a continuous skeleton having the same shape as the above-described mold master. The infiltrant fills the connected porosity of the skeleton, and is in contact with the outer layers of austenitic manganese steel but is not in contact with the core of the ferroalloy granules. On cooling, the core portions of the ferroalloy granules are transformed to martensitic or perlitic steel. The outer layers of the ferroalloy granules retain their austenitic manganese steel structure. The particle-to-particle dimensions of this composite structure are preserved, thereby locking-in or retaining the original dimensions of the mold master. Optionally, if the infiltrant contains a component (other than manganese) which will react with or alloy with the iron powder granules, then, at the interface between the skeleton and infiltrant, additional crystalline compositions of iron and the reactive or alloying infiltrant component can optionally form into one or more intermediate shells or zones adjacent the skeleton and bulk of the infiltrant.

The manganese content in said outer layers of austenitic manganese is between about 4 to about 70 percent of the weight of infiltrant which infiltrates said skeleton. Preferably, such manganese content is between about 15 and 45 percent of the weight of said infiltrant, and most preferably is between about 20 and 30 weight percent.

Examination of a polished metallurgical section of a finished composite article of this invention under optical magnification shows that the ferroalloy granules retain the original particle shape and spacing of the iron powder granules. The finished composite article exhibits relatively little dimensional change when compared to the master from which the preform was molded. Dimensional change of a shaped article of this invention prepared from $A_6$ tool steel and copper-manganese infiltrant according to the present invention is generally less than about 1 percent in any lineal dimension, and frequently less than about 0.5 percent. This low degree of dimensional change is surprising in view of the extensive dimensional change, occuring as shrinkage of greater than about 2 percent, which occurs when a composite is prepared from $A_6$ tool steel infiltrated with copper.

Figure 2A:
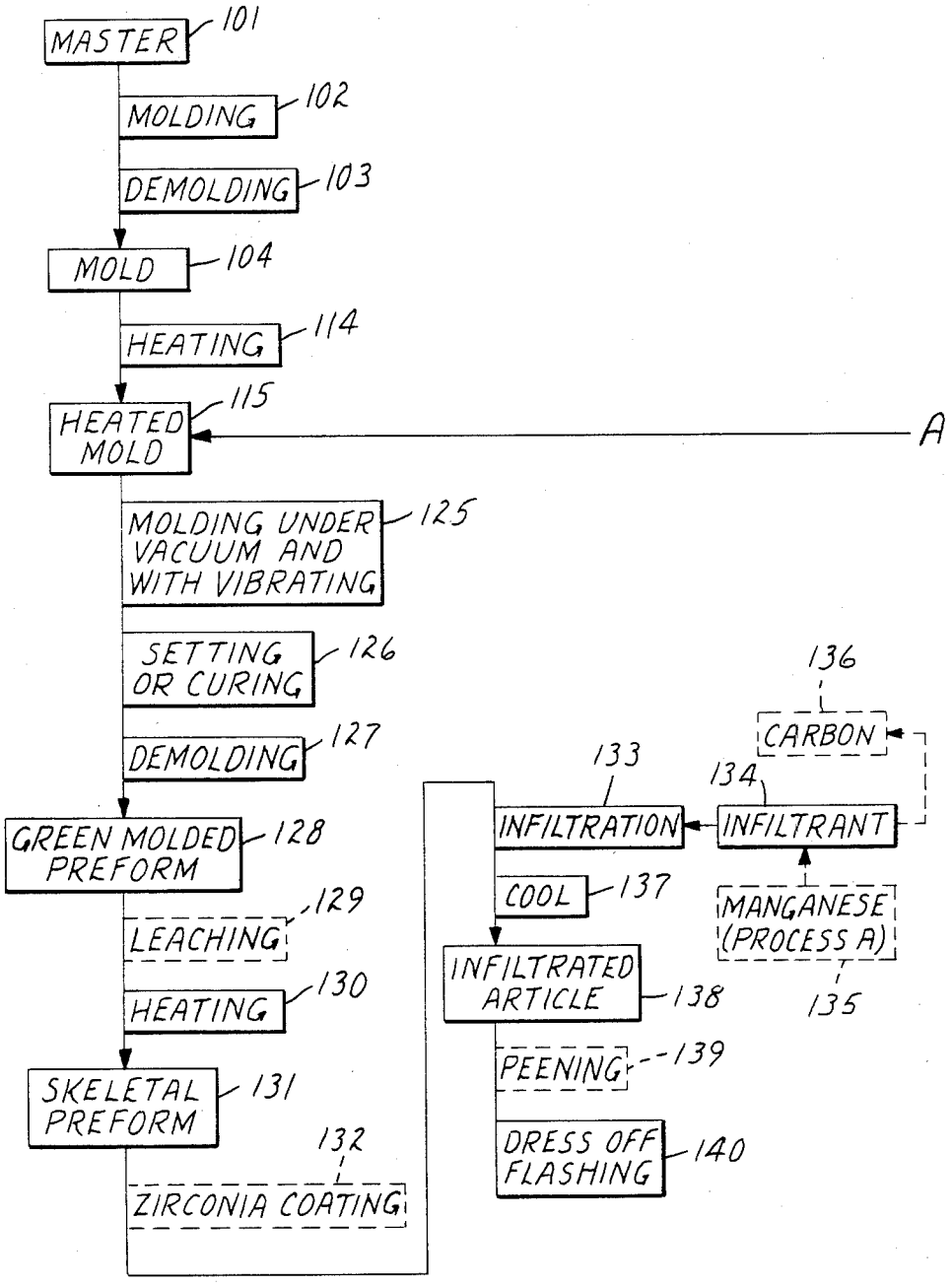
FIGS. 2A and 2B are a flow diagram showing preferred steps in the manufacture of precision shaped articles of this invention.
Figure 2B:
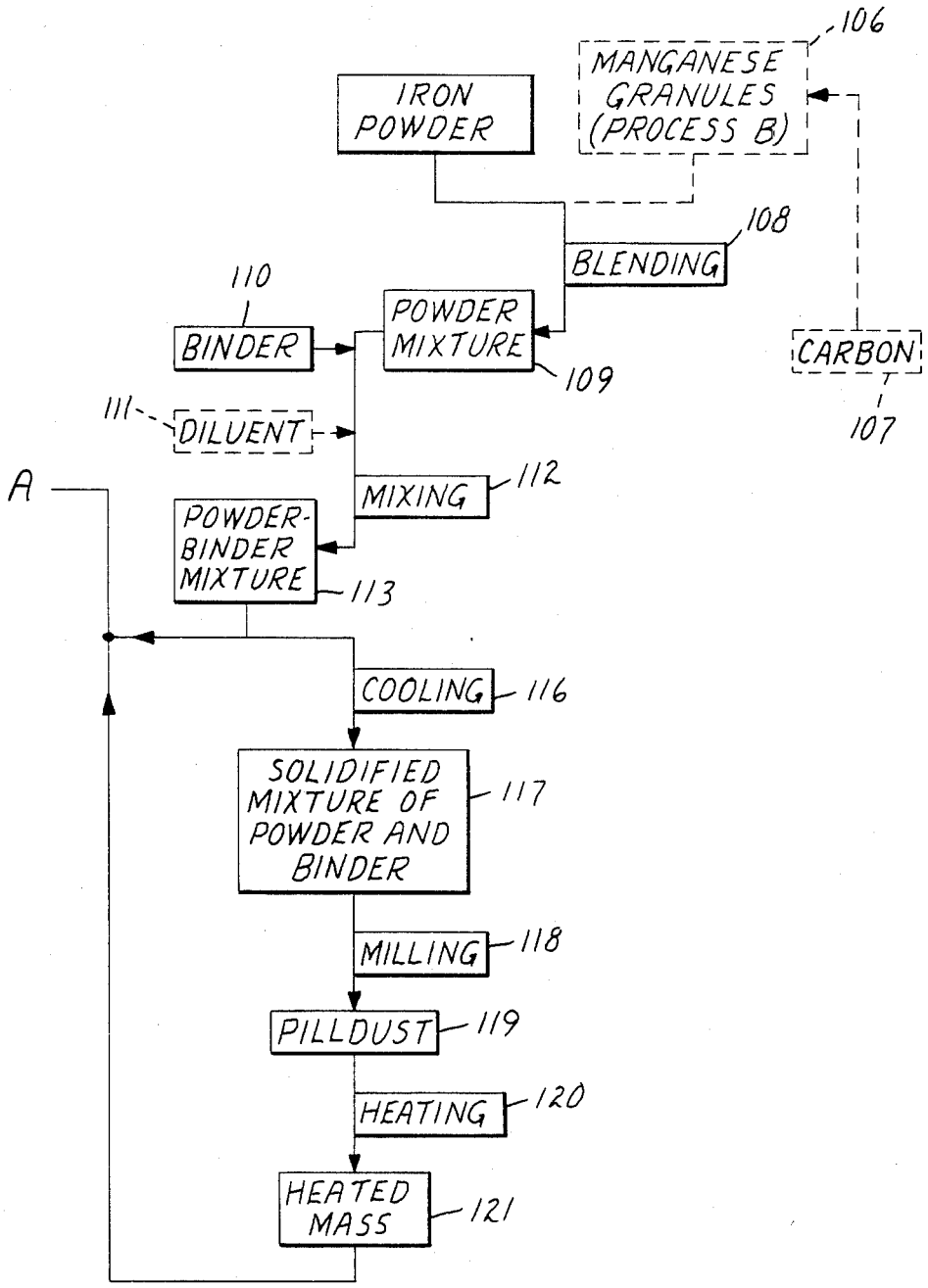

Referring to FIGS. 2A and 2B, which illustrate Processes A and B for forming articles of this invention, a replicating master 101 is used to mold 102 a flexible form in the desired shape by surrounding the master with an elastic, rubbery, molding compound, and demolding 103 the master from the cured solid rubbery mold 104. An admixture of iron powder granules 105 and, in Process B, powdered manganese granules 106 (and, for Process A or B, optional carbon 107) is blended 108 to form a powder mixture 109 which is next combined with a heat fugitive thermoplastic or thermoplastic and thermosetting binder 110 and any optional diluents 111 by mixing 112 (without causing premature cure of the binder if a thermosetting binder is used) in a blending device, e.g. a sigma blade mixer, resulting in formation of a powder-binder mixture 113. The metal granules are uniformly dispersed in the binder matrix conducive to forming a preform with homogeneous (i.e., uniform) density which will be essentially uniformly porous when the binder is thermally degraded. The powder-binder mixture is preferably warmed 10° C. to 20° C. or more above the softening point of the thermoplastic binder component.

The flexible mold 104 is heated 114 and the powder-binder mixture 113 fed directly to the heated mold 115. Optionally, instead of immediately molding the powder-binder mixture, a mixture made with a thermoplastic binder can be cooled 116 to a solidified mass 117 and milled 118, preferably in a vacuum, to a granular or free-flowing consistency ("pill dust" 119) for easy handling and storage, and subsequently heated 120 to a heated mass 121 at the time of the molding step. The heated mold and its contents (the powder-binder mixture 113 or heated mass 121) are vibrated under vacuum 125 in order to degas the mixture. By choosing the proper size distribution of metal particles and a suitable organic binder, the consistency of the powder-binder mixture is such that the mixture can be molded with only slight vibration to ensure removal of air pockets or gas bubbles.

After filling the warmed, evacuated mold, vibration of the mold is discontinued and the mold is isothermed, e.g., maintained at a constant temperature 10° C. to 30° C. above the softening point of the binder (for a thermoplastic binder) or maintained at the thermal cure temperature (for a binder containing thermoset resin), for about 1 to 24 hours. The mold and its contents are vibrated for a short period during such isotherm to bring the mold and the green molded part into dimensional conformity.

If the binder is a thermoplastic which melts at a fairly low temperature, e.g., 35° C. to 40° C., then it is necessary to cool the mold and its contents to the point where the binder sets 126 and becomes fairly rigid (e.g., to 0° C. to 5° C.) to demold the green molded part, preferably in a desiccator to reduce moisture condensation. If the binder contains thermoset resin, then such cooling is not required, as the binder will cure 126 and the green molded part can be demolded at the isotherm temperature. The solid green article can be easily demolded 127 by application of a vacuum to the exterior of the flexible mold. Vacuum demolding allows easy demolding of shapes that have undercuts. After demolding, the resultant "green" molded preform 128 is a faithful replica of the dimensions of the master. This molded shape has good green strength and uniform density due to the hardened matrix of binder which holds the powdered metal granules together.

If a mixture of thermoplastic and thermoset binders was used to make the green molded preform, then the thermoplastic binder can be partially removed from the green molded preform by optionally leaching 129 the preform in a solvent such as methylethylketone or water for a period of about 4 to about 12 hours or less.

The green molded preform 128 is packed in a non-reactive refractory powder, e.g., alumina or silica, to prevent sagging or loss of dimension, and subsequently heated 130 in a furnace to a temperature of about 780° C. or more to thermally degrade the binder. If mixtures of thermoplastic and thermoset binders are used, or if diluted binders are used, the heating step is carried out in a series of stages in order to first remove those materials which boil off or degrade at low temperatures, followed by removal of the remainder of the binder. During the heating step, the bulk of the binder is removed from the article by vaporization and as gaseous products of degradation, leaving a minute amount of amorphous carbonaceous residue which may help to tack the powdered metal granules together. A heating schedule found suitable for articles as large as 125 $cm^3$ when, for example, polyethylene glycol distearate is used for the organic binder, is as follows:

Step 1: from room temperature to 200° C. (about 43° C. per hour)

Step 2: from 250° C. to 400° C. (about 7.5° C. per hour)

Step 3: from 400° C. to the light sintering temperature (about 100° C. per hour).

This programmed heating is carried out under a protective atmosphere, e.g., hydrogen-argon, hydrogen, argon, or other neutral or reducing atmospheres known in the powder metallurgy art to prevent oxidation of the metal granules.

Heating the green molded article to a temperature in excess of about 1050° C. when alumina is used as the refractory non-reactive support material may cause some alumina to adhere to the green molded article. For this reason, when a final light sinter temperature in excess of about 1050° C. is intended, the light sintering process may be stopped at about 1050° C. and the resulting coherent, handleable molded article can be cooled and removed from the alumina bed. Alumina adhering to the surface of the article is gently removed and the article heated to the desired final light sintering temperature without supporting the article in non-reactive refractory powder. Where light sintering temperatures of less than about 1050° C. are employed, surface adhering support material can be removed by gentle brushing with a camel's hair brush.

After sintering of the green molded article, the powdered metal granules and carbonaceous residue form a rigid, handleable, metallurgically integral, porous, monolithic skeletal preform 131. The term "metallurgically integral" as used herein means that there is solid state interatomic diffusion, i.e., there is a solid state bond formed between the various metal particles of the skeleton. The metal granules essentially retain their original particle shapes and relative positions when viewed under optical magnification.

A skeletal preform made by the above heat fugitive binder method will have minimal closed porosity. The major portion of the void space in such a preform will represent connected porosity. Only connected porosity can be filled by molten infiltrant.

The preform is next infiltrated with the infiltrant. If desired, infiltration can be carried out immediately after thermal degradation of the binder and without cooling of the skeletal preform.

The surfaces of the skeletal preform which will be coincident with the working surfaces of the final infiltrated article are preferably coated 132 with a dispersion of zirconia in acetone in order to eliminate overwetting, i.e., "beading" or "blooming" of infiltrant at those surfaces of the skeletal preform. The infiltration step 133 is preferably carried out by supporting the skeletal preform 131 and infiltrant 134 (which, in Process A, contains manganese 135 and in Process A or B can contain optional carbon 136) in or on a bed of alumina in a crucible, for example, one made of graphite, alumina, or mullite. The infiltrant (in solidified form) is placed either in contact with the base of the skeletal preform or not in such contact but flowable under the influence of gravity toward that area of the metal skeleton through which infiltration is to occur.

The preform and infiltrant are heated above the melting point of the infiltrant, but to a temperature below the melting point of the iron powder granules 105 (and, when Process B is used, preferably to a temperature below the melting point of the manganese granules 106). Infiltration is preferably carried out at temperatures not greatly in excess of the melting point of the infiltrant. The amount of infiltrant is usually chosen to be slightly in excess of the amount necessary to fill the connected porosity of the skeletal preform (as determined by calculation or empirically). When the melting point of the infiltrant has been reached, the infiltrant will melt and "wick" into the interior (the connected porosity) of the skeletal preform by capillary action. Heating is continued until the desired degree of diffusion of manganese into the iron powder granules occurs (this temperature may be the same as the melting point of the infiltrant or a higher temperature). The infiltrated preform is then cooled 137, the infiltrated article 138 extracted, and any excess zirconia coating is removed, e.g., by peening 139 with a glass bead peening apparatus (e.g., Empire Abrasive Equipment Corp. Model No. S-20) at a pressure of 1.4 to 2.8 kg/cm$^2$ using an 8 mm diameter orifice. If an age hardenable infiltrant is employed, e.g., copper or copper-manganese powders containg nickel (15%) and tin (7%), or if the metal skeleton is hardenable, the infiltrated article may be subjected to a temperature aging cycle, using techniques well known in the art of metalworking, to change the grain structure of the interior or surface of the composite and increase the hardness and/or wear resistance of the infiltrated article. However, when such a temperature aging treatment is employed, the ferroalloy granules of the infiltrated article should not be converted to a completely or essentially completely homogeneous structure. Finally, excess flashing is dressed off 140 and any superfluous base material is machined or cut away from the shaped working surface to produce the finished infiltrated molded article.

The time and temperature necessary to achieve the desired degree of manganese diffusion into the iron powder granules will vary depending upon the choice of infiltrant, the rate of heating, the gross dimensions of the preform being infiltrated, the wetting characteristics of the infiltrant-skeleton combination, and the diameter of the pore-like passages within the skeleton. These times and temperatures are determined empirically using microscopic analysis of the infiltrated sample. An infiltrated article which has been insufficiently heated will not undergo sufficient manganese diffusion. Microscopic analysis of such an article will reveal that the ferroalloy granules have not become fully enveloped with an outer layer of austenitic manganese steel. Excessive heating of the infiltrated article may cause diffusion of manganese throughout the ferroalloy granules, and microscopic analysis of such articles will reveal that an essentially uniform steel phase is present throughout the ferroalloy granules. Also, an infiltrated article which has been excessively heated may undergo liquid phase reactions between the iron powder granules and infiltrant due to melting of the iron powder, and microscopic analysis of such an article will reveal that the ferroalloy granules have been greatly reduced in size due to reaction with the infiltrant. In addition, an excessively heated article may be characterized by severe distortion or dimensional change relative to the desired master shape.

The resulting infiltrated molded article, such as a copper infiltrated article, is substantially void-free (i.e., it has a density at least 97% and usually 99% or more of the theoretical density based upon the densities of the constituents of the preform and of the infiltrant phase). Essentially the only uninfiltrated space in such an infiltrated article is the closed porosity of the original preform. The connected porosity of the original preform is essentially completely occupied by the infiltrant.

Figure 3:
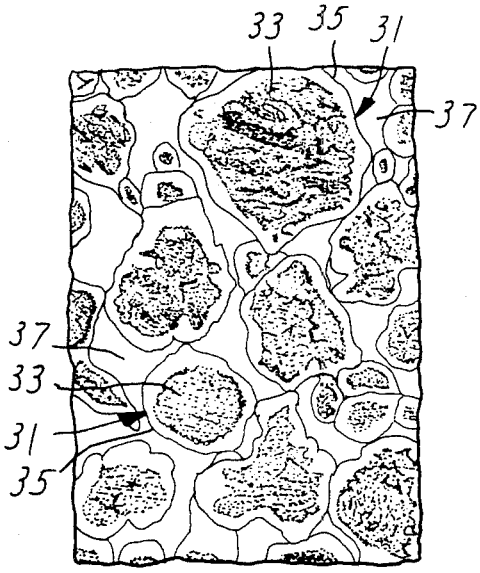
FIG. 3 is a pen-and-ink sketch of an optical micrograph of an article of this invention.

The metallurgical structure of an infiltrated molded article of the present invention can be further understood by reference to FIG. 3. FIG. 3 is a pen-and-ink drawing of an optical micrograph (taken at a magnification of 750×) of a polished sample of the present invention, prepared as described in Example 1. Ferroalloy granules 31 have a core 33 of 50 percent martensitic steel (estimated) surrounded by a thin shell or film 35 of austenitic manganese steel. Ferroalloy granules 31 are interconnected at their contiguous points of contact and are intermeshed with copper-manganese infiltrant matrix 37.

Without intending to be bound by theory, it is believed that when the composite material depicted in FIG. 3 receives an impact, the austenitic manganese steel layer 35 undergoes work hardening, thereby enabling the composite to absorb impact while minimizing the tendency of the composite to fracture. However, the extensive plastic deformation observed in ordinary Hadfield manganese steel only minimally occurs in the composite material of FIG. 3, because the austenitic manganese steel structure is microstructurally dispersed throughout the composite and is locked in place by the other components of the composite.

The composite material shown in FIG. 3 has particular utility as a molded die cavity.

Figure 4:
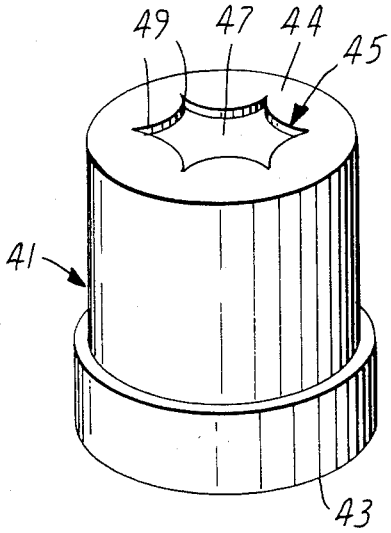
FIG. 4 is a view in perspective of one embodiment of the molded die cavities of this invention.

A molded die cavity prepared according to the present invention can be further understood by reference to FIG. 4. FIG. 4 is a perspective view of a molded die cavity 41 having a base 43 and a working surface 44. Female recess 45 lies in the end of cavity 41 opposite the base and has indented surface 47 and scallops 49. The shape of recess 45 corresponds to a male shape in the form of a fluted wheel.

Objects and advantages of this invention are illustrated in the following examples but the amounts and materials described in the examples, and various additions and details recited therein, should not be construed to limit the scope of this invention.

EXAMPLE 1

A Charpy unnotched impact bar was machined to the dimensions specified in ASTM E-23-72 (Reapproved 1978), but modified so that cross-section dimensions of 1.01 cm±0.008 cm were used. A mold corresponding to this shape was made by surrounding the bar with "RTV-J" curable silicone rubber. The mold was cured and the bar removed from the mold. Six hundred grams of powdered $A_6$ tool steel having a mean diameter less than 44 micrometers (commercially available from Stellite Div. of Cabot Corp.) was hand mixed with a 30.5 gram portion of a polymer binder ("Emerest 2642", commercially available from Emery Industries) which had been preheated to 65° C. The powdered metal and polymer binder were heated to 65° C. The resulting mixture contained approximately 29 volume percent binder.

The flexible rubber mold was heated to 66° C. by storing it in a 66° C. oven for about 15 minutes. The warm powder-binder mixture was then flowed into the warm flexible mold and vibrated, using a Model J 50A "Jogger", (commercially available from Syntron Division of FMC Corp.) at a rheostat setting of 85. The mixture was deaired for 10 minutes with continued vibration in a laboratory vacuum chamber operated at 3 torr. The mold and its contents were then placed in a 66° C. oven for 1 hour, vibrated for 5 minutes at a rheostat setting of 40 and allowed to cool at room temperature (23° C.) for two hours. The mold and contents were then brought to 40° C. for 1 hour in a dessicator containing anhydrous calcium sulfate. The mold and its contents were removed from the dessicator, and the hardened, "green" molded preform then extracted from the rubber mold cavity using vacuum.

The green molded preform was placed in a graphite boat containing a supporting bed of powdered alumina ("A-100", commercially available from Alcoa, Inc.), vibrated slightly to pack the alumina powder around the green molded preform, and placed in a resistance-heated, cam-controlled box furnace (commercially available from the Lindberg Co.). The furnace was evacuated to 0.5 Torr at a sufficiently slow rate to prevent scattering of the alumina powder within the furnace. The furnace was backfilled with an atmosphere containing 95% argon and 5% hydrogen. A dynamic argon atmosphere was maintained in the furnace at a flow rate of 85 liters/hour. The furnace was heated from room temperature to 750° C. at a rate of 50° C./hour over a period of about 14 hours. The furnace was maintained at 700° C. for ½ hour, at which point the binder had completely degraded and the skeletal particles in the matrix had become tacked together.

The resulting molded skeletal preform was cooled to room temperature under the dynamic gas atmosphere of the furnace. The molded skeletal preform was removed from the alumina bed and gently brushed with a camel's hair brush to remove surface adhering alumina. An acetone dispersion of zirconia (10 g of 1 to 5 micrometer mean diameter zirconia powder in 100 ml acetone) was sprayed on all but one surface (the base) of the preform in order to prevent the infiltrant metal from overwetting the working surfaces The base of the preform was then placed adjacent 50 g of a prealloyed slug containing 65 weight percent copper and 35 weight percent manganese, on a bed of alumina in an open graphite crucible in a molybdenum wound electrical resistance furnace. The furnace was evacuated to 0.05 torr, backfilled with hydrogen at atmospheric pressure and maintained under a dynamic hydrogen atmosphere at a flow rate of 141 liters/hour. The furnace was heated to 1000° C. and maintained at that temperature for 15 minutes in order to carry out infiltration of the skeletal preform by the copper-manganese infiltrant and diffusion of manganese into the granules of $A_6$ tool steel. The furnace was then turned off and allowed to cool at about 70° C./hour. The exterior zirconia coating was removed from the infiltrated article by glass bead peening with less than 44 micrometer mean diameter glass beads at a pressure of 1.4 to 2.8 kg/cm$^2$.

Microscopic analysis of a metallurgically prepared sample of the infiltrated article shows that the martensitic steel structure of the interior of the $A_6$ tool steel granules was surrounded by an outer layer of austenitic manganese steel. The copper-manganese infiltrant had completely filled the connected porosity of the skeletal preform.

Shrinkage was measured by comparing the master shape to the final molded article. The article was tested for Rockwell C hardness and Charpy notched impact (simple beam, Type A) according to ASTM E-103-61 (Reapproved 1979) and ASTM E-23-72 (Reapproved 1978). The final molded article exhibited the following characteristics:

Dimensional Change: −0.6%
Rockwell hardness ($R_c$): 30
Charpy notched impact: 4.75 joules (3.5 ft.-lbs)

This Example shows that the articles of this invention faithfully reproduced the dimensions of the mold master and had excellent physical properties. Repetition of the example gave essentially identical articles.

EXAMPLE 2

Using the method of Example 1, molded composite articles were prepared by substituting 72/20/8 weight % copper/manganese/tin infiltrant for the infiltrant used in Example 1. The resulting infiltrated articles exhibited dimensional change of −0.5%, $R_c$ of 31, and Charpy notched impact strength of 4.3 joules (3.2 ft.-lbs).

COMPARATIVE EXAMPLE

Using the method of Example 1, molded composite articles were prepared without use of a manganese-containing infiltrant or addition of manganese granules to the powder-binder mixture. The only manganese present was the manganese which is typically present in $A_6$ tool steel (approximately 2.25 wt. % of the $A_6$ powder). The powder-binder mixture was molded, fired, and infiltrated as in Example 1, but with copper powder ("R-64", commercially available from Gould, Inc.) as infiltrant. A temperature of 1100° C. was required to melt the copper powder and carry out infiltration. The oven was maintained at 1100° C. for 15 minutes. The resulting infiltrated article exhibited dimensional change of −2.3%, $R_c$ of 33, and Charpy notched impact strength of 2.5 joules (1.9 ft.-lbs.). The low level of impact strength and high level of shrinkage of the final article rendered it very poorly suited for use as a molded die cavity.

When this comparative example was repeated using a 300° C./hour cooling rate after infiltration, the resulting infiltrated article exhibited dimensional change of −1.9% and a $R_c$ of 42.

This Comparative Example shows that the use of manganese in the articles of this invention contributed greatly to impact strength and to preservation of dimensional fidelity during manufacture of final infiltrated articles.

Various modifications and alterations of this invention will be apparent to those skilled in the art without departing from the scope and spirit of this invention and the latter should not be restricted to that set forth herein for illustrative purposes.

What is claimed is:

1. A metal composite article comprising:

(a) a monolithic skeleton consisting essentially of interconnected granules of a ferroalloy of about 1 to about 100 micrometers mean diameter, having a core of martensitic or perlitic steel and an outer layer of austenitic manganese steel; and (b) a continuous metallic phase occupying the connected porosity in said skeleton, said continuous phase comprising a solid metal or alloy which wets said skeleton and has a melting point below the melting point of said core of said ferroalloy granules;

with said manganese representing between about 4 percent and about 70 percent of the total weight of said continuous metallic phase plus said manganese of said layer, said article thereby comprising two intermeshed matrices and being substantially free of voids.

2. An article according to claim 1, wherein said ferroalloy granules are about 50 to about 80 percent of the volume of said article.

3. An article according to claim 1, wherein said ferroalloy granules are about 65 to about 75 percent of the volume of said article.

4. An article according to claim 1, wherein said granules of ferroalloy have a mean diameter of about 1 to about 44 micrometers.

5. An article according to claim 1, wherein said core of said ferroalloy is $A_6$ tool steel.

6. An article according to claim 1, wherein said continuous metallic phase is about 20 to about 50 percent of the volume of said article

7. An article according to claim 1, wherein said continuous metallic phase is about 25 to about 35 percent of the volume of said article

8. An article according to claim 1, wherein said continuous metallic phase is copper alloy.

9. An article according to claim 1, wherein said core is $A_6$ tool steel and said continuous metallic phase comprises copper-manganese alloy.

10. An article according to claim 1, wherein said manganese of said layer of austenitic manganese steel is about 15 to about 45 percent of the total weight of said continuous metallic phase plus said manganese of said layer.

11. An article according to claim 1, wherein said manganese of said layer of austenitic manganese steel is about 20 to about 30 percent of the total weight of said continuous metallic phase plus said manganese of said layer.

12. A precision molded die cavity comprising:

(a) about 50 to about 80 volume percent of a monolithic ferroalloy skeleton of interconnected granules of about 1 to about 44 micrometers mean diameter, said granules consisting essentially of a core of $A_6$ tool steel and an outer layer of austenitic manganese steel; and (b) about 20 to about 50 volume percent of a continuous metallic phase comprising copper-manganese alloy, said continuous metallic phase occupying the connected porosity in said skeleton;

with said manganese of said layer of austenitic manganese steel representing between about 4 percent and about 70 percent of the total weight of said continuous metallic phase plus said manganese of said layer, said article thereby comprising two intermeshed matrices and being substantially free of voids.

13. A die cavity according to claim 12, wherein said manganese of said layer is about 15 to about 45 percent of the weight of said total weight.

14. A die cavity according to claim 12, wherein said manganese is about 20 to about 30 percent of the weight of said total weight.

15. A process for forming a precision molded composite article, comprising the steps of:

(a) blending granules of iron powder having about 1 to about 100 micrometers mean diameter with up to 50 volume percent of a heat fugitive, organic binder, thereby forming a uniform mixture;

(b) molding the resulting mixture in a heated flexible mold, cooling said mold and its contents to room temperature, and demolding said contents by applying a vacuum to the outside of said mold thereby forming an essentially void-free green molded preform having the size and shape of said mold;

(c) heating said green molded preform to thermally remove said binder and form a rigid, handleable skeletal preform;

(d) placing said skeletal preform in contact with a metal or alloy infiltrant which will wet said skeleton and which has a melting point less than or equal to the melting point of said iron powder;

(e) infiltrating said skeletal preform with said infiltrant by heating said skeletal preform and said infiltrant above the melting point of said infiltrant, but below the melting point of said iron powder, whereby said infiltrant melts and wicks into the connected porosity of said preform by capillary action and fully envelopes said granules of iron powder, with a first proviso that if said iron powder granules are plain iron, then carbon is added to said mixture of step (a), or carbon is present in said infiltrant alloy of step (b), a second proviso that manganese granules are added to said mixture of step (a), or manganese is present in said infiltrant of step (d), and said manganese is about 4 to about 70 percent of the weight of said infiltrant plus the weight of said manganese granules, and a third proviso that said heating of this step (e) is carried out until said manganese diffuses into the outer surface region of said iron powder granules, thereby forming ferroalloy granules consisting essentially of an outer layer of austenitic manganese steel and a core of martensitic or perlitic steel; and (f) cooling the infiltrated part to room temperature to form a substantially void-free precision molded article.

16. A process according to claim 15, wherein said iron powder granules are selected from the group consisting of $A_6$, 1040, 1018, and $M_2$ tool steels.

17. A process according to claim 15, wherein manganese is present in said infiltrant of step (d).

18. A process according to claim 17, wherein said infiltrant comprises copper-manganese alloy.

19. A process according to claim 15, wherein said manganese is about 15 to 45 percent of the weight of said infiltrant.

20. A process according to claim 15, wherein said manganese is about 20 to 30 percent of the weight of said infiltrant.

21. A process according to claim 15, wherein said iron powder granules comprise $A_6$ tool steel and are between about 65 and about 75 percent of the volume of said article, said infiltrant comprises copper-manganese alloy and is about 25 to about 75 percent of the volume of said article, said manganese is about 15 to about 45 percent of the weight of said infiltrant, and said molded article is a die cavity.

22. A process according to claim 15, wherein the change in any lineal dimension between the dimensions of said void-free green molded preform and the dimensions of said void-free precision article is less than about 1 percent.

23. A process according to claim 22, wherein said change in any lineal dimension is less than about 0.5 percent.

24. A process according to claim 22, wherein said article has a density at least 97 percent of the theoretical density of said article.

25. A process according to claim 22, wherein said article has a density at least 99 percent of the theoretical density of said article.

* * * * *